United States Patent [19]

Dombroski et al.

[11] Patent Number: 4,711,320

[45] Date of Patent: Dec. 8, 1987

[54] WHEEL FLANGE AND RAIL LUBRICATOR APPARATUS

[75] Inventors: Robert M. Dombroski, McFarland; John P. Kayser, Madison, both of Wis.

[73] Assignee: Madison-Kipp Corporation, Madison, Wis.

[21] Appl. No.: 785,571

[22] Filed: Oct. 8, 1985

[51] Int. Cl.[4] ..... B61K 3/00; F01M 5/00

[52] U.S. Cl. ..... 184/3.2; 184/6.22

[58] Field of Search ..... 184/3.1, 3.2, 6.4, 15.1, 184/15.2, 15.3, 108, 6.22

[56] References Cited

U.S. PATENT DOCUMENTS

| | | | |
|---|---|---|---|
| 3,059,724 | 10/1962 | Soule | 184/3.1 |
| 3,165,171 | 1/1965 | Baeriswyl | 184/3.2 |
| 3,635,310 | 1/1972 | Roll | 184/3.2 |
| 3,760,904 | 9/1973 | Luthar | 184/3.2 |
| 4,368,803 | 1/1983 | Dombroski | 184/15.3 |
| 4,537,285 | 8/1985 | Brown | 184/15.2 |

FOREIGN PATENT DOCUMENTS

| | | | |
|---|---|---|---|
| 79/00307 | 6/1979 | PCT Int'l Appl. | 184/3.1 |
| 1068089 | 5/1967 | United Kingdom | 184/3.1 |

*Primary Examiner*—Carlton R. Croyle
*Assistant Examiner*—Jane E. Obee
*Attorney, Agent, or Firm*—Marshall, O'Toole, Gerstein, Murray & Bicknell

[57] ABSTRACT

A wheel flange and rail lubricating apparatus with adjustable features to accurately lubricate the frictional contact area between a locomotive wheel flange and rail during normal locomotive operations. A system controller, a lubricant distribution system and one or more nozzle assemblies are provided. The controller allows the user to define a lubrication cycle which can be optimized on an individual basis with flexibility to control the lubrication cycle in accordance with the distance traveled by the locomotive, speed variations, time, curves, etc. The lubrication interval is set to deliver a precise amount of lubricant and can be adjusted to take into account the viscosity of the lubricant as well as the ambient temperature. A curve sensor repetitively initiates a lubrication cycle each time the locomotive enters a curve. A wheel position sensor delays and prevents discharge of the lubricant until the nozzle and the point to be lubricated are properly aligned.

5 Claims, 8 Drawing Figures

WHEEL FLANGE AND RAIL LUBRICATOR APPARATUS

This invention relates to automated lubricating apparatus and in particular to such apparatus for lubricating the fricational contact area between a locomotive wheel flange and rail during operation of the locomotive.

BACKGROUND OF THE INVENTION

In the railroad industry, it is known that there are occasions where the locomotive wheel flange contacts the rail, causing a frictional build-up of heat and wearing of both the wheel and the rail. Such undesired contact of the wheel flange and the rail occurs in several instances, such as in non-parallel or shifting rails, swiveling of the trucks which house and mount the wheels to the locomotive car, and during a curved track section when the wheel flange is in almost constant contact with the rail.

The amount of lost energy expended in the wheel flange contacting the rail can be appreciable, especially in situations where a locomotive may pull one hundred cars. For instance, it has been estimated that a savings of 5–20% of the locomotive fuel requirements could be attained if one could eliminate or substantially reduce the frictional contact between the wheel flange and the rail. In the case of a large railroad, a 5% savings in fuel can amount to about $150,000 per month.

Accordingly, it is highly desired to minimize the effects of frictional engagement between the wheel flange and the rail. This can be achieved by proper lubrication using a lubricating system which will serve to apply lubricant at the right location to obtain the desired results of decreased fuel consumption and decreased wear, but without applying lubricant to undesired locations which may lead to unsafe conditions or to increased maintenance requirements. That is, lubrication should be applied to the radius area between the wheel flange and the wheel tread, with some lubricant application extending onto the flange. However, no lubricant should be applied to the wheel tread which is in driving and braking contact with the rail crown. Several attempts have been made to apply the proper amount of lubricant at the desired location, none of which are satisfactory in providing reliable and predictable lubricating results in a locomotive environment.

In one known system, air is mixed with a lubricant and sprayed onto the wheel flange with a spray which resembles the output from a conventional aerosol can. Spraying of lubricant at high locomotive speeds and/or with high wind velocities, results in the lubricant spray being dissipated before reaching the desired location or being sprayed onto other undesired areas of the train. In another available system, a rubber tire is mounted for rotation by the locomotive wheel. The tire contains slits with openings through which oil is released as the rubber tire rotates.

Among the disadvantages of such prior art devices are the inability to vary the rate of application of lubricant, and the undesirability of a rapidly dissipating lubricating spray or oil drip lubricant as compared to a heavyduty lubricant. Thus, it is desired to provide an accurate and reliable lubricating apparatus for locomotive wheel flanges and rails which permits a variety of lubrication applications for conditions of distance, speed, time, curved track sections, temperature, lubricant viscosity, etc.

SUMMARY OF THE INVENTION

In accordance with the principles of the present invention, there is provided an automated lubricating apparatus for lubricating the frictional contact area between a locomotive wheel flange and rail during operation of the locomotive and which is accurate in lubricant dispensing, highly reliable, and flexible to meet a wide variety of operating requirements. The apparatus includes a microprocessor-based lubrication controller which can be preset to provide a lubrication cycle corresponding to a variety of locomotive and track operating conditions, as well as compensate for the type of lubricant, lubricant viscosity, and outside temperature. In particular, the lubrication cycle can be preset as a function of the distance traveled by the locomotive, with appropriate compensation for speed variations, curves or time.

In a preferred embodiment of a lubricator for lubricating a locomotive wheel flange, there is provided a lubrication nozzle mounted adjacent to the wheel flange and coupled to a lubricant source for directing shots of lubricant in a thin, coherent stream to the wheel flange and the radius area between the flange and wheel tread. Means are provided for sensing the distance traveled by the locomotive. A lubrication controller includes means for presetting one of a plurality of distance intervals, D, to be traveled by the locomotive between lubrication cycles, L. The lubrication controller controls the application of a shot of lubricant for a preset distance interval, D, traveled by the locomotive in response to the preset distance, D, and the distance sensing means. The controller actuates a corresponding lubrication cycle, L, during which lubricant is applied to the wheel flange from the nozzle.

The distance sensing means also provides a speed indication which can be used to adjust the preset distance interval between lubrication cycles. Thus, the lubrication interval can be a constant, a step function or a ramp function to provide more or less lubrication at higher locomotive speeds or as the speed increases. Curve sensing means provide an output signal which initiates a lubrication cycle repetitively during a curved track section.

The controller may also be preset in one of a plurality of lube time durations, Q, within the lubrication cycle corresponding to a predetermined amount of lubricant to be dispensed. Means are also provided for selecting and presetting an adjustment in the lube time duration, Q, to compensate for the viscosity of the lubricant as well as for the ambient temperature. Thus, if a cold temperature is sensed by the temperature sensor, a lengthening is made in the lube time duration, Q, so as to adjust for the desired amount of lubricant. A wheel position sensor is included to delay lubricant ejection until the wheel flange and nozzle are in the desired proper alignment so that accurate lubrication dispensing to the desired location is achieved.

Accordingly, the present invention provides a very flexible lubricating apparatus for locomotive wheel flanges having the following features:

1. Deliver one lubricant shot for a predetermined increment of distance traveled;
2. Preset and adjust for the quantity of lubricant ejected with each shot;
3. Compensate for lubricants of various viscosity;
4. Adjust for the ambient temperature in response to a sensed temperature condition;

5. Provide a modification in the distance interval between lubrication cycles in accordance with the locomotive speed changes;

6. Initiate a lubrication cycle in response to a curved track sensed condition.

BRIEF DESCRIPTION OF THE DRAWINGS

The invention may be best understood by reference to the following description taken in conjunction with the accompanying drawings in which like reference numerals identify like elements in the several figures and in which.

DETAILED DESCRIPTION

Figure 1:
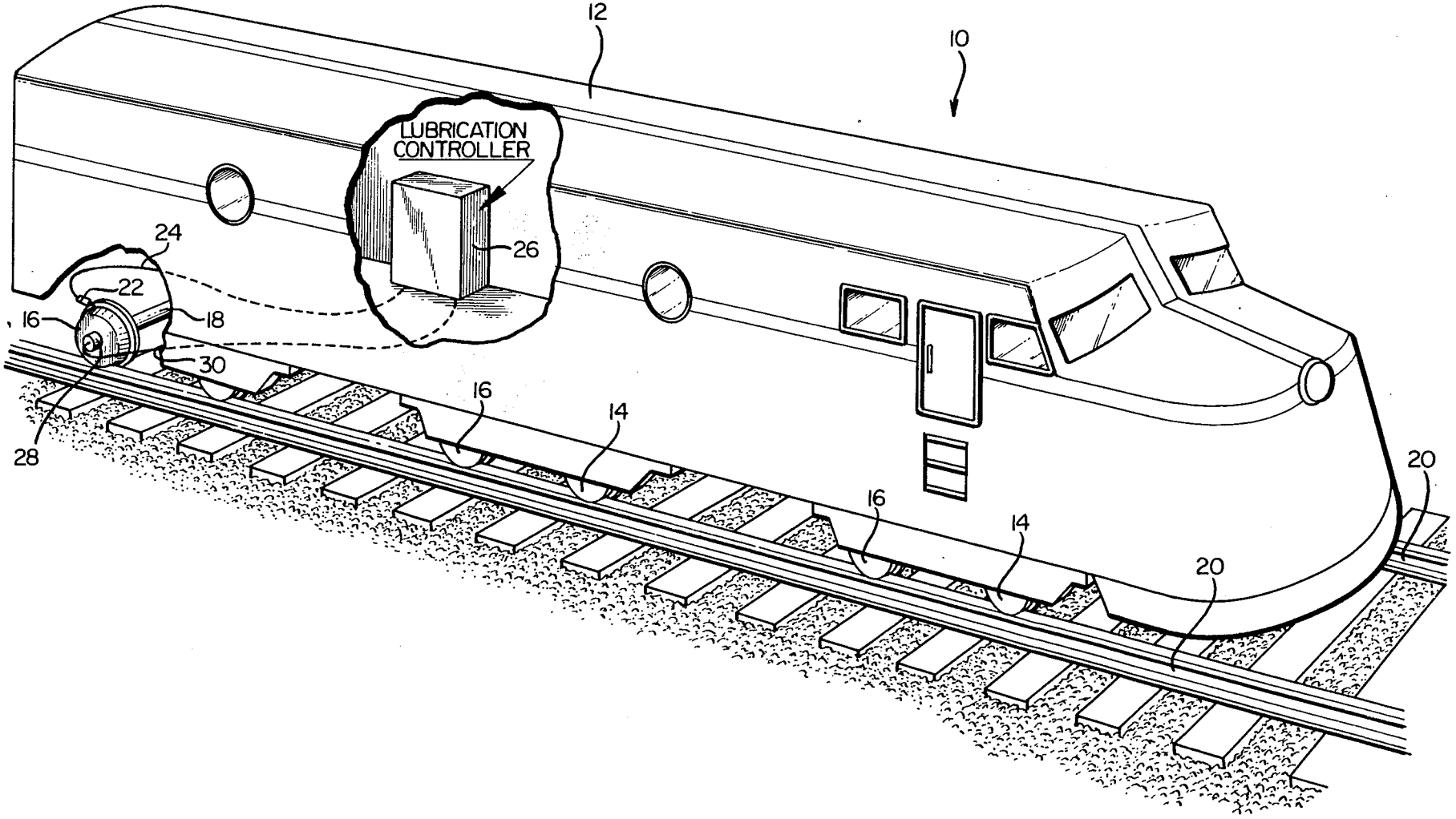
FIG. 1 is a perspective view of a locomotive including apparatus for lubricating the wheel flange and rail.

Referring now to FIG. 1, there is illustrated a locomotive 10 including a car 12 from which is mounted a number of trucks 14 housing locomotive wheels 16 on axles 18, with the wheels resting on rails 20. In accordance with the present invention, there is provided a lubricant nozzle 22 mounted for applying a shot of lubricant to the wheel flange for lubricating the frictional contact area between wheel and rail. Similar apparatus may be applied to other selected locomotive wheels.

Nozzle 22 is connected through line 24 to a cabinet 26 mounted in the cab of car 12 and containing apparatus to be hereinafter described for controlling the application of lubricant. A distance measuring device 28 is attached to wheel 16 and connected via line 30 to the controller in cabinet 26. Distance measuring device 28 senses the distance traveled by locomotive 12 and supplies appropriate signals on line 30. Device 28 may be for instance, a speed sensing type device from which a distance indication can be obtained using the known ten feet circumference of a train wheel. As an example, a General Electric Company Speed-Sensing Alternator, type MM24 could be utilized.

Figure 2:
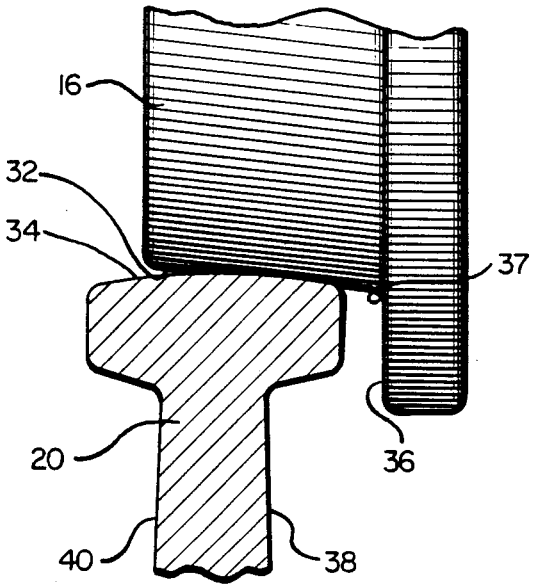
FIG. 2 is an elevational view, partly in section illustrating a train wheel, wheel flange and rail.
Figure 3:
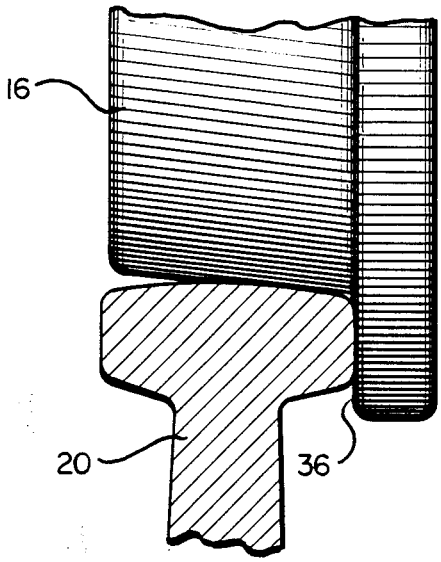
FIG. 3 is an elevational view similar to that of FIG. 2 illustrating the wheel flange contacting the rail and leading to a substantial increase in friction and wear of the wheel and rail.

FIGS. 2 and 3 illustrate the contact between wheel 16 and rail 20 in two different situations. In FIG. 2, tread portion 32 of the wheel is shown resting on crown 34 of the rail. Wheel flange 36, with a radius area 37 between the flange and tread, is located on gauge side 38 of the rail opposite from the rail field side 40. FIG. 2 illustrates the desired location of wheel flange 36 and the rail which is attained when the track is new and straight, and when truck 14 carrying wheels 16 is not swiveling.

FIG. 3 illustrates the position of flange 36 in direct frictional engagement with the rail. This condition occurs when for instance the track becomes misaligned or is weaving, or the track is in a curved section, or when the truck 14 is swiveling. In such conditions, it is desired to apply lubricant to the frictional surfaces engaged between the rail and wheel flange. In particular, it is desired to apply lubricant to radius area 37 and extending slightly onto flange 36, but not directly on tread 32 or crown 34.

Figure 4:
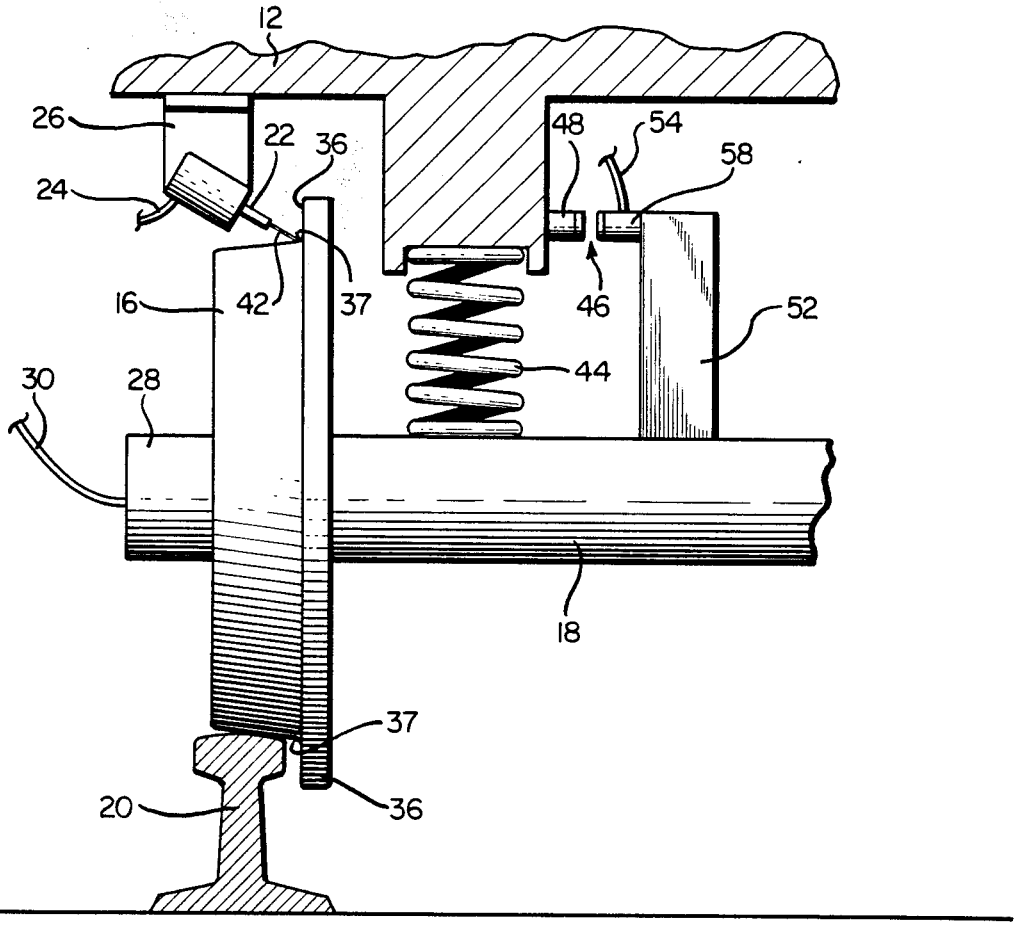
FIG. 4 is an elevational view, partly in section, illustrating proper alignment of the wheel flange and the lubrication nozzle, and means for sensing the proper alignment, as well as a distance and speed measuring sensor.

FIG. 4 illustrates nozzle 22 mounted by a suitable bracket 26 from the car 12 so that lubricant shots 42 can be applied to wheel 16 at flange 36 and radius area 37. Spring 44 dampens vertical movement of axle 18 and wheel 16 with respect to the train body. A wheel position sensor 46 includes a protrusion 48 of magnetic material and a proximity switch 50 mounted adjacent protrusion 48 by means of a bracket 52. In the position shown in FIG. 4, proximity switch 50 detects the presence of protrusion 48 which corresponds to nozzle 22 being aligned in the proper position with respect to flange 36 and radius area 37. If the wheel 16 moves up or down relative to nozzle 22, the corresponding displacement and misalignment of proximity switch 50 with protrusion 48 will provide a suitable signal on line 54 to delay or inhibit the application of lubricant through nozzle 22. This prevents the application of lubricant to undesired locations and prevents wasteful misapplication of lubricant.

Figure 5:
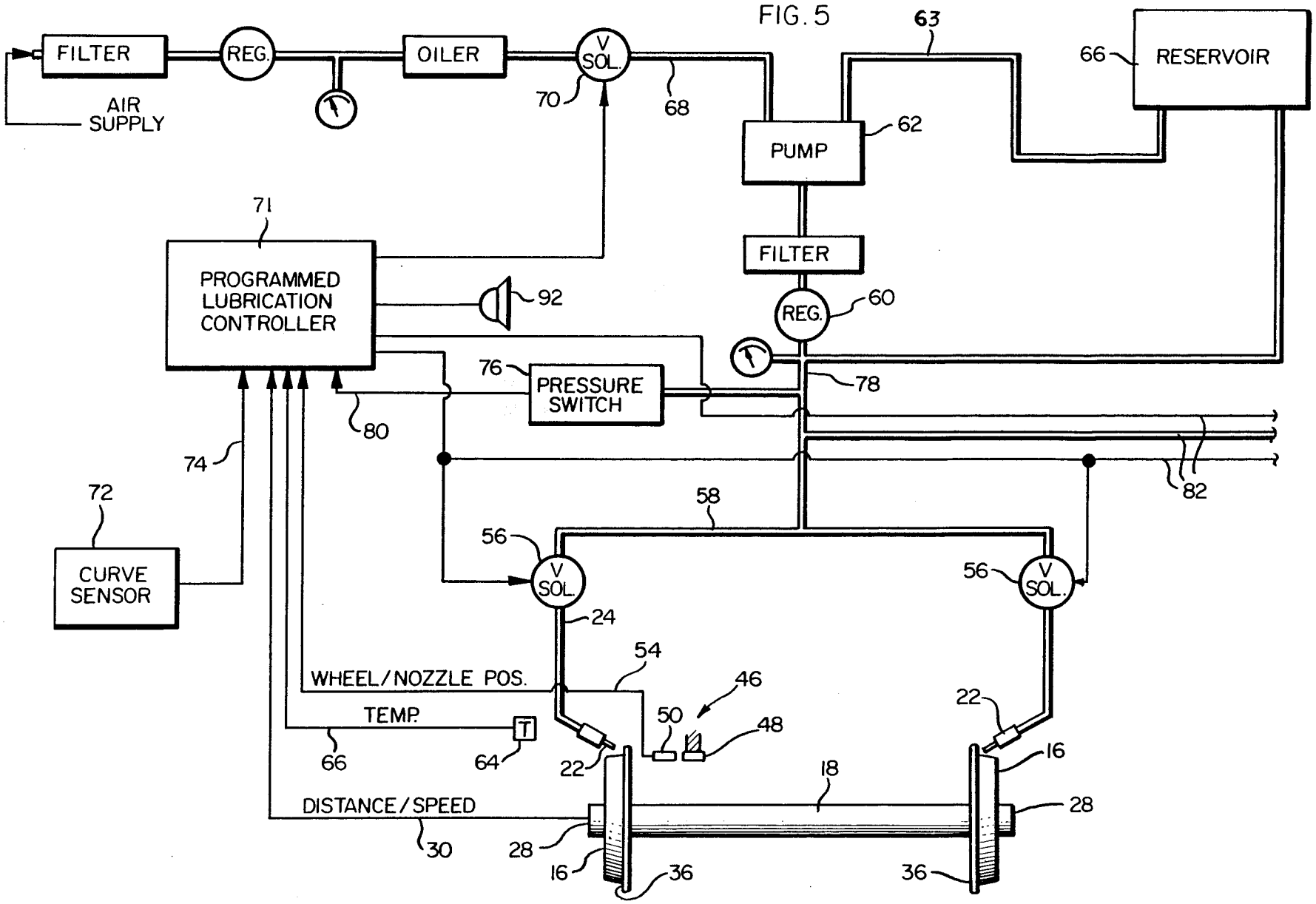
FIG. 5 is a schematic diagram illustrating the hydraulic, pneumatic, and electrical components and interconnections of the lubricating apparatus of the present invention.

FIG. 5 is a schematic diagram illustrating the various components of a lubricator apparatus in accordance with the present invention. Lubrication nozzle 22 is connected through hydraulic line 24 to a solenoid valve 56 which in turn is connected through line 58 to a regulator 60. Lubrication supply pump 62 is interconnected through suitable hydraulic line 63 to a lubrication reservoir 66 on one side and in turn on the other side through suitable pneumatic line 68 to a compressed air supply. Solenoid valve 71 is interposed in the line between the air supply and pump 62 to control pressurization of the lubrication lines.

A temperature sensor 64 for sensing the ambient air temperature may be located adjacent wheel 16 or may be mounted outside the cab portion of locomotive 10. The output of temperature sensor 64 is coupled on line 66 to a programmed lubrication controller 70. Similarly, the signal from a curve sensor 72, mounted for instance in the locomotive cab, is coupled by line 74 to the controller. The curve sensor can be any type of device which senses the locomotive being in the presence of a curved rail or curved track section and provides a signal to the controller to initiate a lubrication cycle. The curve sensor may be a magnetic type device, or an accelerometer, or a gyroscopic-type device.

The illustrated filter, regulator, oiler, and pressure gauges are standard-type devices utilized in lubricating apparatus. Pressure switch 76 senses the pressure in hydraulic line 78 and provides a corresponding output on line 80 to the controller.

As can be seen in FIG. 5 a corresponding nozzle 22 and solenoid valve 56 are provided for the opposite wheel on axle 18. Lines 82 are provided for lubricating additional locomotive wheels. For instance, if the illustrated wheel in FIG. 5 is a forward wheel, lines 82 would be similarly provided to the aft wheel.

In operation, controller 70 initiates a lubrication cycle based on the distance traveled by the locomotive. Controller 70 calculates the distance traveled using a speed/distance input signal on line 30. The lubrication cycles can be for instance as frequent as every ten feet or as long as every 20 miles. When a lubrication cycle is initiated, solenoid valve 70 and pump 62 are activated and the lubricant pressure in supply line 78 is increased to a nominal level of 300 psi, depending on the exact lubricant used. At the appropriate time in the lubrication cycle, controller 70 actuates solenoid valves 56 for a precisely controlled interval to discharge a thin coherent stream of lubricant. The lubricant stream may be from 0.06 to 0.12 inch wide. The quantity of lubricant discharged, that is, the lubricant shot volume, is set in the controller 70 and is temperature compensated to insure consistent performance. After the lubricant is discharged, pump 62 and solenoid valve 70 are deactivated so that there is no pressure in the lubricant supply lines.

The following description is in connection with a wheel flange lubricating device such as illustrated in FIG. 5 where nozzle 22 is positioned immediately adjacent the wheel flange to accurately deliver a lubricant shot to radius area 37 of the flange. Alternatively, the nozzle may be located to deliver a lubricant shot to a desired location on the rail as will be described hereinafter. In the wheel flange lubricator, controller 70 is programmed to deliver one lubricant shot for a predetermined increment of distance traveled. Controller 70 is a microprocessor based unit corresponding to the discrete logic unit shown in U.S. Pat. No. 4,368,803, assigned to the same assignee as herein, and which patent description is incorporated herein by reference. The present microprocessor based system provides for instance similar functions as link detector 34, link counter 52, pass counter 54, lube duration counter/gate 88, and relay select 70 units shown and described in U.S. Pat. No. 4,368,803.

Figure 6:
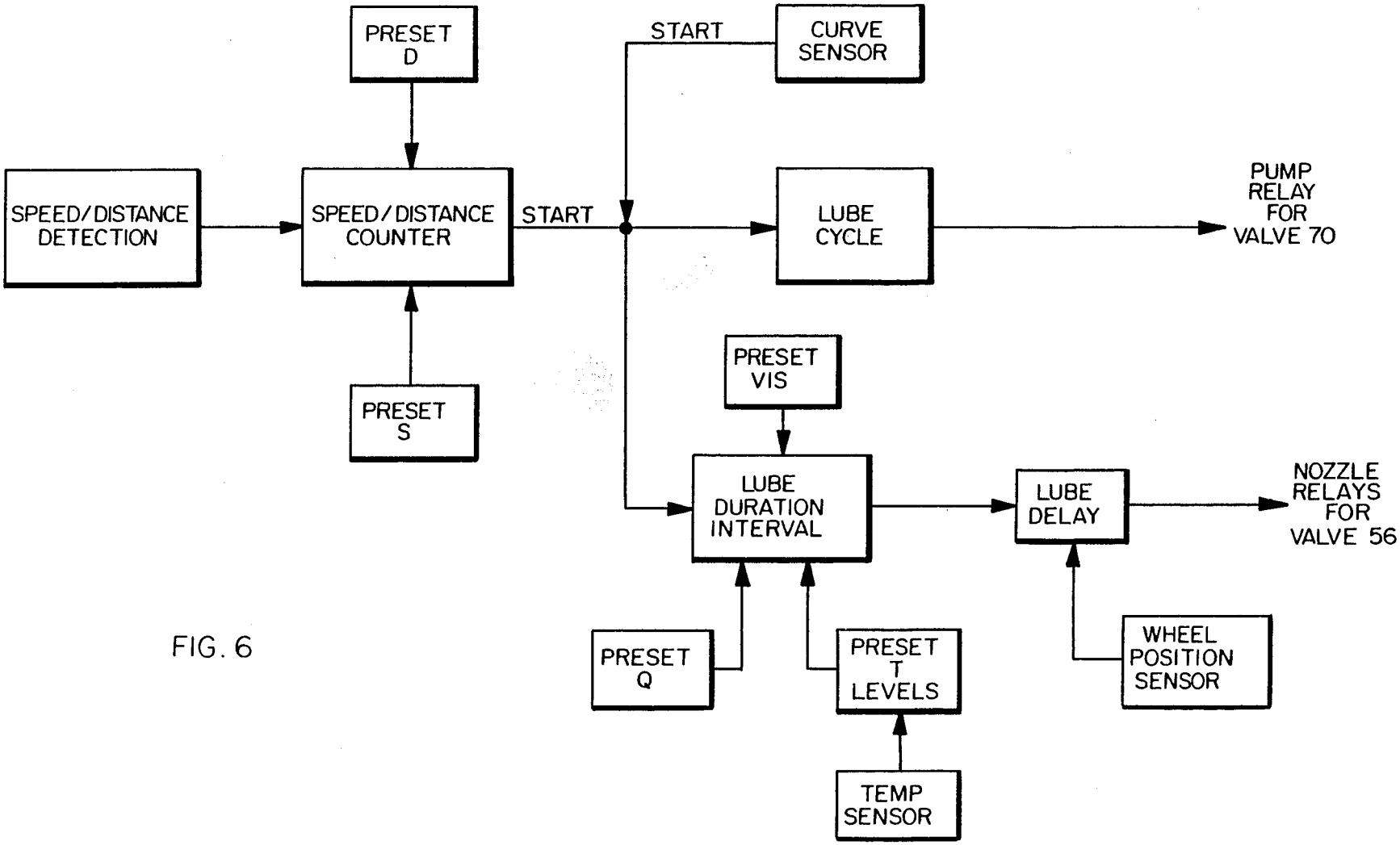
FIG. 6 is a block diagram illustrating the essential elements of a lubrication controller for controlling the lubrication apparatus.
Figure 7:
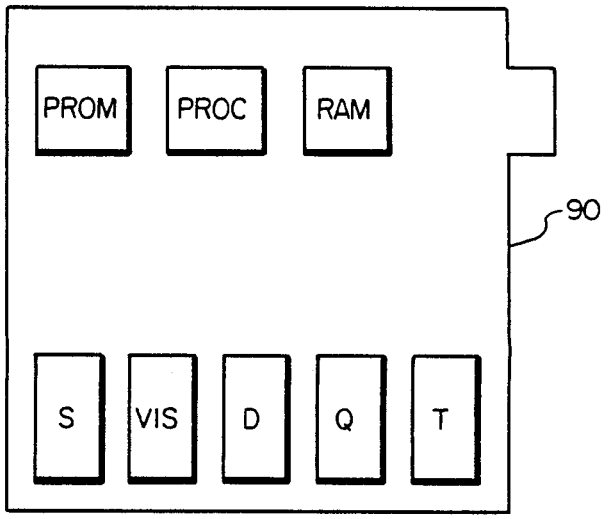
FIG. 7 is a schematic representation of the circuit board containing the microprocessor controller elements and preset DIP switches for presetting various inputs into the controller.

The microprocessor based system of the present application includes several inputs and outputs as noted in FIG. 5. For purposes of the present description of a wheel flange locomotive lubricator, reference may be made to FIGS. 6, 7, and 8 as well as the following description which sets forth the necessary details for the microprocessor structure, function and results for the purpose of this illustration. FIG. 7 shows a processor circuit board 90 in schematic representation with illustration of the Processor, PROM, and RAM units. Several DIP switches labeled "S", "VIS", etc. are shown at the bottom of circuit board 90 for entering information into the microprocessor. These are the on-board inputs which are also shown in FIG. 6 in the blocks correspondingly labeled Preset D, Preset S, etc., and are initially adjusted for presetting the corresponding values into the processor controller as follows.

ON BOARD INPUTS (DIP SWITCHES):

1. LUBE QUANTITY: The volume of lubricant to be discharged is set into the Q switches. A total of 256 discrete settings are provided with increments between settings of approximately 2% to set the nominal lubricant volume in cubic inches between 0.001 and 0.150. The nominal "on" time of solenoid valve 56 is set to discharge a specific quantity of lubricant.

2. DISTANCE INTERVAL (Wheel mode): The distance traveled between lubrication cycles is set in the D switches.

3. SPEED THRESHOLDS: The distance interval, D, may be modified in the S switches as a function of the locomotive speed. For instance, a low speed threshold can be entered to prevent the controller from undesirably initiating a lubrication cycle when the locomotive is traveling below a certain speed such as when traveling in the railroad switch yard. Alternatively, low and high speed thresholds may be set to provide a lubrication cycle modification of the distance interval D so that more or less lubricant is supplied at higher locomotive speeds or as the locomotive speed increases.

4. LUBRICANT VISCOSITY: The nominal "on" time, Q, of solenoid valve 56 is adjusted by settings in the VIS switches to compensate for lubricants of various viscosity. Higher viscosities require a longer "on" time. As an example, settings of the VIS switches are provided to adjust for lubricant viscosities ranging from less than 400 SSU at 100° F. to NLGI-1.

6. TEMPERATURE COMPENSATION: The nominal "on" time, Q, of solenoid valve 56 is adjusted according to temperature switch input settings, T. Longer valve 56 "on" times are required as the ambient air temperature decreases. The output of temperature sensor 64 will activate a series of for instance, eight temperature sensitive switches, each one set for a specific switching point.

In addition to the aforementioned on board inputs, several off board inputs are provided from sensors and other devices as follows.

OFF BOARD INPUTS (MOMENTARY SWITCH CLOSURE)

1. DISTANCE: One input for each locomotive wheel revolution is provided on line 30 by speed/distance sensor 28.

2. CURVE: A lubrication cycle is initiated repetitively whenever the locomotive is in a curve as sensed by curve sensor 72.

3. WHEEL POSITION SENSOR: Lubricant ejection will be delayed until wheel position sensor 46 indicates a proper relationship between wheel 16 and nozzle 22.

4. PUMP SWITCH: A malfunction alarm 92 is activated and the lubrication function is inhibited if supply pump 62 completes two successive strokes which may indicate a lubrication line leakage. Pressure switch 76 may also be activated if the normal pressure is not reached in lubrication line 78 so that the lube pump 62 will be turned off and malfunction alarm 92 will be sounded. Malfunction alarm 92 may also be sounded as desired if there is no distance interval, D, input, or if there is no temperature input, or if the reservoir 66 is empty.

FIG. 6 is a functional block diagram and information flow chart schematic for controller 70, its on board preset inputs, off board inputs, and outputs. The speed/distance detection is provided by detector 28 with the output on line 30 to controller 70. A speed/distance counter having preset inputs D and S can provide a Start or Initiate signal to initiate a Lube Cycle and the Lube Duration Interval. The Lube Cycle may also be initiated by the curve sensor. FIG. 6 further illustrates the Lube Duration Interval with the preset values of Q, VIS and T-levels (as set and modified by the temperature sensor). This provides an output to suitable relays for actuating solenoid valves 56, which actuation can be delayed by wheel position sensor 46.

Figure 8:
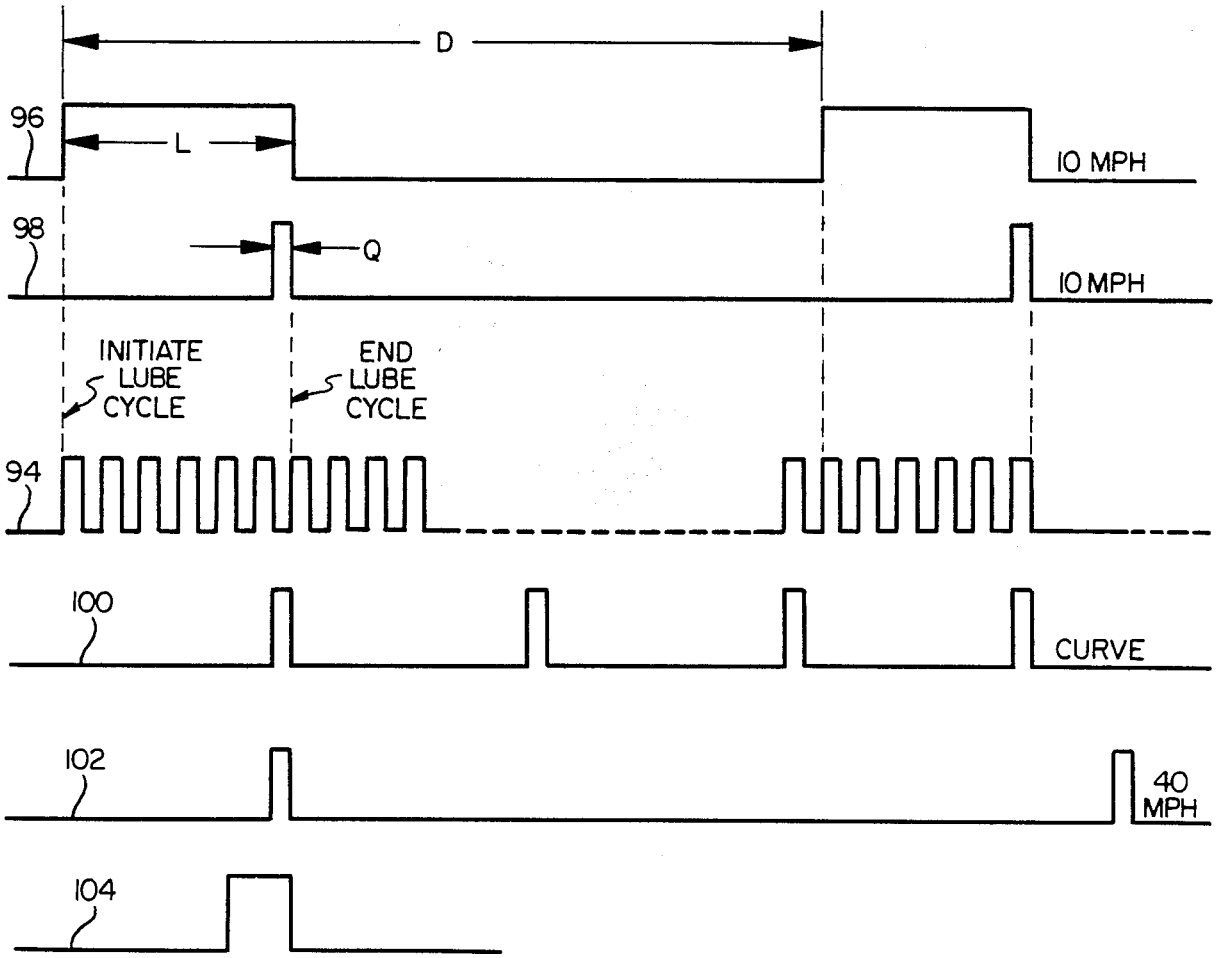
FIG. 8 is a waveform diagram illustrating various waveform in the present system and useful for explanation of the system operation.

FIG. 8 illustrates a timing waveform diagram helpful in understanding the operation of the present system. Waveform 94 represents the speed/distance input information from sensor 28. Waveform 96 represents the waveform conforming to a lubrication cycle L which is initiated once for each distance interval, D. Upon initiation or starting of the lube cycle a signal is sent to solenoid valve 70 to pressurize the lubrication lines. Waveform 98 represents the lubrication duration interval, Q, as modified by the viscosity and temperature, and is provided once in each lubrication cycle. Waveforms 96 and 98 may represent for instance the conditions for a locomotive traveling at 10 mph.

FIG. 8 also illustrates a waveform 100 indicating the manner in which the lubrication interval is modified to increase the lubrication on a curve in response to the curve sensor. Waveform 102 represents the increasing of the lubrication interval, D, as provided by a preset S input when the locomotive is traveling faster than 10 mph or for instance, 40 mph. Waveform 104 illustrates the lengthening of the lube duration interval, Q, by a setting for the viscosity or as modified by temperature.

In an alternative embodiment, nozzle 22 may be positioned near rail 20 to provide a direct rail lubricating apparatus. In this instance, the length of track to be lubricated may be set into a suitable DIP switch on circuit board 90 in FIG. 7 so that solenoid valves 56 will be activated for the duration or increment corresponding to the setting.

In accordance with standard practice, other functions such as a test function or a remote lubrication interval start function can be provided. Such functions have not been illustrated herein as they are conventional and are not a part of the present invention. Also, standard fail-safe functions can be provided. As an example, a time based artificial input mode can be used and initiated to start a lubrication cycle corresponding to a locomotive traveling at a constant speed of approximately 30 mph. Similarly, functions can be provided in the event the temperature sensor is beyond its range or is not functioning. In this case, the controller can be set to assume a constant temperature of approximately 45° F. so that the lubrication system can be continued to be operated.

The foregoing detailed description has been given for clearness of understanding only, and no unnecessary limitations should be understood therefrom, as modifications will be obvious to those skilled in the art.

What is claimed is:

1. Lubricating apparatus for automatically lubricating the frictional contact area between a locomotive wheel flange and rail during operation of the locomotive comprising:

a source of lubricant;

a lubrication nozzle mounted adjacent said wheel flange and coupled to the lubricant source for directing shots of lubricant in a thin, coherent stream to the frictional contact area between the wheel flange and rail;

distance sensing means for sensing the distance traveled by the locomotive;

a lubrication controller including means for selecting and presetting a distance interval, D, to be traveled by the locomotive between lubrication cycles, L, said controller connected to the lubrication nozzle for controlling the application of said shots of lubricant for said preset distance interval, D, traveled by the locomotive;

said controller responding to the distance sending means and the preset distance, D, for actuating a corresponding lubricant cycle, L, during which said shots of lubricant are applied from the nozzle to said frictional contact area;

said controller including preset lube amount means to preset the amount of lubricant applied during the lubrication cycle, L;

said preset lube amount means includes lube duration preset means for selecting and presetting a lube time duration, Q, within the lubrication cycle, L, with the lube duration, Q, corresponding to a precise, predetermined amount of lubricant;

wherein said preset lube amount means further includes lube viscosity adjustment means, VIS, for selecting and presetting an adjustment in the lube time duration, Q, to compensate for the viscosity of the lubricant in the lubrication source; and, temperature sensing means for sensing the ambient temperature and providing a corresponding output signal, wherein said preset lube amount means further includes temperature adjustment means with preset temperature levels, T, responsive to said sensed temperature output signal for selecting and presetting an adjustment in the lube time duration, Q, to compensate for the ambient air temperature acting on the lubricant.

2. Lubricating apparatus according to claim 1, including curve sensing means for sensing a curve being traversed by the locomotive, and wherein said controller includes curve adjustment means responsive to said sensed curve and providing an adjustment in the preset distance interval, D, between lubrication cycles, L.

3. Lubricating apparatus according to claim 1, including means for sensing the position of the wheel and the corresponding lubrication nozzle, and for enabling lubricant application only if there is proper alignment between the wheel and nozzle.

4. Lubricating apparatus according to claim 1 wherein said distance sensing means includes means for sensing the speed of the locomotive.

5. Lubricating apparatus according to claim 4, wherein said lubrication controller includes preset speed adjustment means for selecting and presetting a speed threshold level, S, for adjusting the preset distance interval, D, between lubrication cycles, L.

* * * * *